US009852705B2

(12) United States Patent
Kim et al.

(10) Patent No.: US 9,852,705 B2
(45) Date of Patent: Dec. 26, 2017

(54) METHOD FOR CONTROLLING A DISPLAY OF AN ELECTRONIC DEVICE

(71) Applicant: Samsung Electronics Co., Ltd., Gyeonggi-do (KR)

(72) Inventors: Jung-Hyun Kim, Gyeonggi-do (KR); Hyun-Chang Shin, Gyeonggi-do (KR); Moon-Soo Kim, Seoul (KR); Joo-Hyun Kim, Seoul (KR)

(73) Assignee: Samsung Electronics Co., Ltd (KR)

( * ) Notice: Subject to any disclaimer, the term of this patent is extended or adjusted under 35 U.S.C. 154(b) by 69 days.

(21) Appl. No.: 14/939,754

(22) Filed: Nov. 12, 2015

(65) Prior Publication Data

US 2016/0133204 A1 May 12, 2016

(30) Foreign Application Priority Data

Nov. 11, 2014 (KR) ..... 10-2014-0156306

(51) Int. Cl.
*G09G 3/36* (2006.01)

(52) U.S. Cl.
CPC ... *G09G 3/3614* (2013.01); *G09G 2320/0257* (2013.01); *G09G 2320/041* (2013.01)

(58) Field of Classification Search
CPC ..... G09G 3/3614; G09G 2320/0257; G09G 2320/041
See application file for complete search history.

(56) References Cited

U.S. PATENT DOCUMENTS

2001/0048498 A1* 12/2001 Tomioka ..... G02F 1/133723 349/123
2002/0089477 A1* 7/2002 Kanbe ..... G09G 3/3648 345/87
2003/0231157 A1* 12/2003 Sugino ..... G02F 1/133382 345/101
2004/0017339 A1* 1/2004 Wang ..... G09G 3/3629 345/87
2004/0119665 A1* 6/2004 Kang ..... G09G 3/293 345/63
2005/0012698 A1* 1/2005 Takahashi ..... G09G 3/3216 345/77
2005/0030264 A1* 2/2005 Tsuge ..... G09G 3/325 345/76
2006/0187361 A1* 8/2006 Fujine ..... G09G 3/3648 348/790
2007/0070003 A1* 3/2007 Nakamura ..... G09G 3/3614 345/87
2007/0177058 A1 8/2007 Jang
(Continued)

FOREIGN PATENT DOCUMENTS

KR 10-2007-0078506 8/2007
KR 10-2013-0112178 10/2013
KR 10-2014-0011577 1/2014

*Primary Examiner* — Ibrahim Khan
(74) *Attorney, Agent, or Firm* — The Farrell Law Firm, P.C.

(57) ABSTRACT

An electronic device and a method of controlling a temperature in an electronic device are provided. The method includes measuring a temperature of at least one part of the electronic device, determining an algorithm corresponding to the measured temperature of the at least one part, and displaying an image based on the determined algorithm.

19 Claims, 11 Drawing Sheets

(56) References Cited

U.S. PATENT DOCUMENTS

| | | | | |
|---|---|---|---|---|
| 2009/0315918 | A1* | 12/2009 | Minami | G09G 3/3233 345/690 |
| 2010/0182352 | A1* | 7/2010 | Nakamura | G09G 3/3233 345/691 |
| 2011/0069048 | A1* | 3/2011 | Cao | G02F 1/1309 345/204 |
| 2011/0199566 | A1* | 8/2011 | Mazusaki | C08G 73/1046 349/123 |
| 2013/0088476 | A1* | 4/2013 | Yamagishi | G09G 3/3648 345/211 |
| 2013/0257884 | A1 | 10/2013 | Koh | |
| 2016/0012789 | A1* | 1/2016 | Miyazawa | G09G 3/3614 345/209 |

* cited by examiner

METHOD FOR CONTROLLING A DISPLAY OF AN ELECTRONIC DEVICE

PRIORITY

This application claims priority under 35 U.S.C. §119(a) to Korean Patent Application Serial No. 10-2014-0156306, which was filed in the Korean Intellectual Property Office on Nov. 11, 2014, the entire content of which is incorporated herein by reference.

BACKGROUND

1. Field of the Disclosure

The present disclosure relates generally to a method of controlling a display of an electronic device, and more particularly, to a method of controlling a temperature of an electronic device when a display of the electronic device is activated.

2. Description of the Related Art

An electronic device may deliver diverse contents (or information) to a user by displaying a graphic interface on a display of the electronic device. The electronic device may display the graphic interface by applying a voltage to the display. Further, when the display of the electronic device is operated for extended periods of time or is maintained in an on configuration for extended periods of time, heat generated in the display accumulates, which causes a temperature of the electronic device and/or the display to increase.

SUMMARY

The present disclosure has been made to address at least the above mentioned problems and/or disadvantages and to provide at least the advantages described below. An aspect of the present invention provides an electronic device. The electronic device applies one or more cancellation algorithms while operating a display to eliminate a distortion that can occur in a graphic interface displayed on the display when a temperature of the display exceeds or falls below a predetermined threshold voltage.

In accordance with an aspect of the present invention, there is provided a method of controlling a display in an electronic device. The method includes measuring a temperature of at least one part of the electronic device, determining an algorithm corresponding to the measured temperature of the at least one part, and displaying an image based on the determined algorithm.

In accordance with an aspect of the present invention, there is provided an electronic device. The electronic device includes a temperature sensor, a display, and a processor configured to measure a temperature of at least one part of the electronic device through the temperature sensor, determine an algorithm corresponding to the measured temperature, and display an image in the display based on the determined algorithm.

In accordance with an aspect of the present invention, there is provided a non-transitory computer readable storage medium including instructions that when executed perform a method of controlling a display in an electronic device. The method includes measuring a temperature of at least one part of the electronic device, determining an algorithm corresponding to the measured temperature of the at least one part, and displaying an image based on the determined algorithm.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
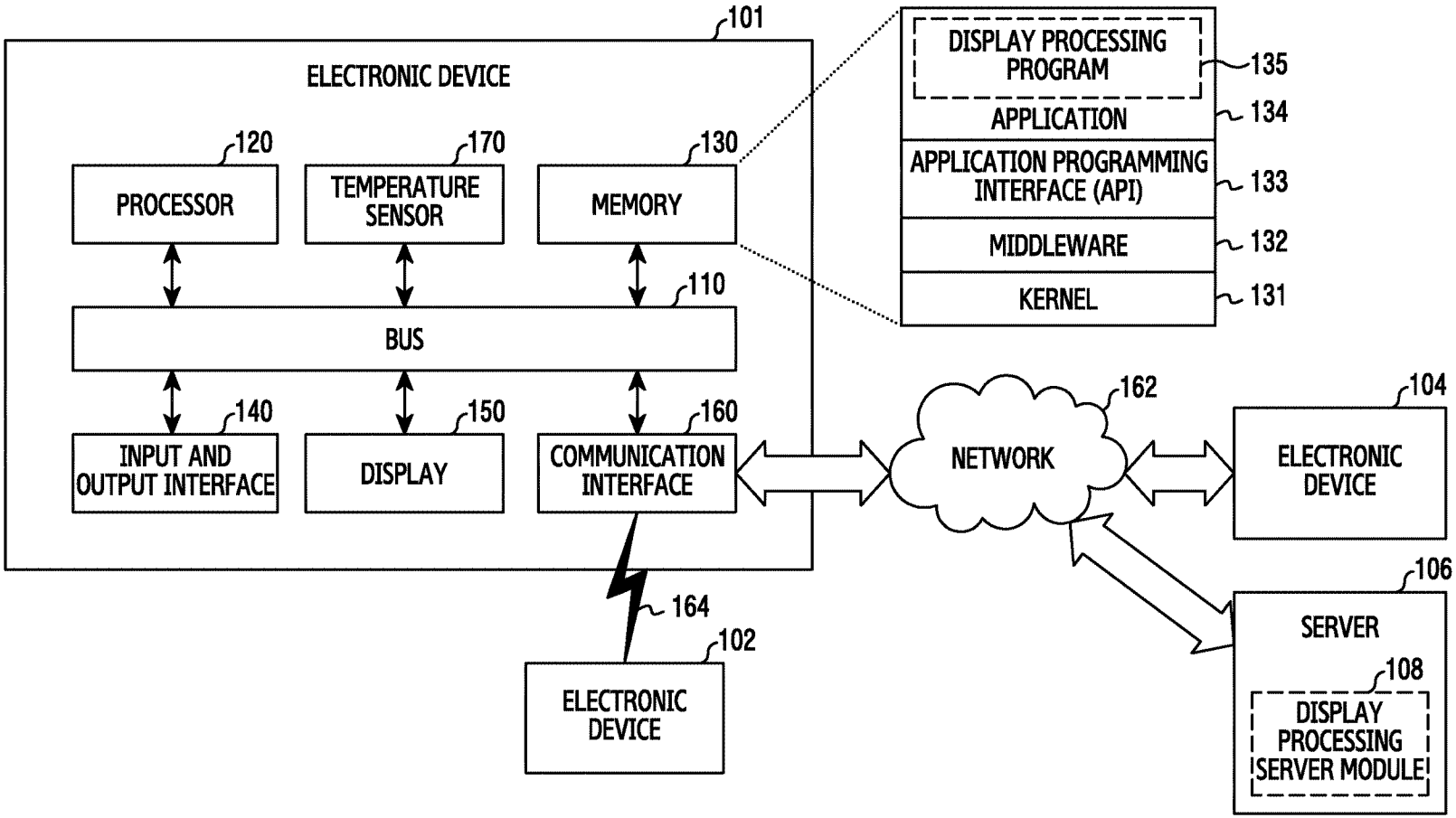
FIG. 1 is a diagram illustrating a network environment including an electronic device, according to an embodiment of the present disclosure.

Embodiments of the present disclosure will be described herein below with reference to the accompanying drawings. However, the embodiments of the present disclosure are not limited to the specific embodiments and should be construed as including all modifications, changes, equivalent devices and methods, and/or alternative embodiments of the present disclosure. In the description of the drawings, similar reference numerals are used for similar elements.

The terms "have," "may have," "include," and "may include" as used herein indicate the presence of corresponding features (for example, elements such as numerical values, functions, operations, or parts), and do not preclude the presence of additional features.

The terms "A or B," "at least one of A or/and B," or "one or more of A or/and B" as used herein include all possible combinations of items enumerated with them. For example, "A or B," "at least one of A and B," or "at least one of A or B" means (1) including at least one A, (2) including at least one B, or (3) including both at least one A and at least one B.

The terms such as "first" and "second" as used herein may modify various elements regardless of an order and/or importance of the corresponding elements, and do not limit the corresponding elements. These terms may be used for the purpose of distinguishing one element from another element. For example, a first user device and a second user device may indicate different user devices regardless of the order or importance. For example, a first element may be referred to as a second element without departing from the scope the present invention, and similarly, a second element may be referred to as a first element.

It will be understood that, when an element (for example, a first element) is "(operatively or communicatively) coupled with/to" or "connected to" another element (for example, a second element), the element may be directly coupled with/to another element, and there may be an intervening element (for example, a third element) between the element and another element. To the contrary, it will be understood that, when an element (for example, a first element) is "directly coupled with/to" or "directly connected to" another element (for example, a second element), there is no intervening element (for example, a third element) between the element and another element.

The expression "configured to (or set to)" as used herein may be replaced with "suitable for," "having the capacity to," "designed to," "adapted to," "made to," or "capable of" according to a context. The term "configured to (set to)" does not necessarily mean "specifically designed to" in a hardware level. Instead, the expression "apparatus configured to . . . " may mean that the apparatus is "capable of . . . " along with other devices or parts in a certain context. For example, "a processor configured to (set to) perform A, B, and C" may mean a dedicated processor (e.g., an embedded processor) for performing a corresponding operation, or a generic-purpose processor (e.g., a CPU or an application processor) capable of performing a corresponding operation by executing one or more software programs stored in a memory device.

The terms used in describing the various embodiments of the present disclosure are just for the purpose of describing particular embodiments and are not intended to limit the present disclosure. As used herein, the singular forms are intended to include the plural forms as well, unless the context clearly indicates otherwise. All of the terms used herein including technical or scientific terms have the same meanings as those generally understood by an ordinary skilled person in the related art unless they are defined otherwise. The terms defined in a generally used dictionary should be interpreted as having the same or similar meanings as the contextual meanings of the relevant technology and should not be interpreted as having ideal or exaggerated meanings unless they are clearly defined herein. According to circumstances, even the terms defined in this disclosure should not be interpreted as excluding the embodiments of the present disclosure.

The term "module" used in the various embodiments of the present disclosure may refer to, for example, a unit including one or more combinations of hardware, software, and firmware. The "module" may be interchangeable with a term, such as a unit, logic, a logical block, a component, or a circuit. The "module" may be the smallest unit of an integrated component or a part thereof. The "module" may be a minimum unit for performing one or more functions or a part thereof. The "module" may be mechanically or electronically implemented. For example, the "module" according to various embodiments of the present disclosure may include at least one of an Application-Specific Integrated Circuit (ASIC) chip, a Field-Programmable Gate Array (FPGA), and a programmable-logic device for performing certain operations, which are now known or will be developed in the future.

An electronic device according to the embodiments of the present disclosure may include at least one of a smartphone, a tablet personal computer (PC), a mobile phone, a video phone, an electronic book reader, a desktop PC, a laptop PC, a netbook computer, a workstation, a server, a Personal Digital Assistant (PDA), a Portable Multimedia Player (PMP), an MP3 player, a mobile medical machine, a camera, or a wearable device (for example, smart glasses, a head-mounted-device (HMD), electronic clothing, an electronic bracelet, an electronic necklace, an electronic appcessory, electronic tattoos, a smart mirror, or a smart watch).

The electronic device may be a smart home appliance. For example, the smart home appliance may include at least one of a television, a Digital Video Disk (DVD) player, a stereo, a refrigerator, an air conditioner, a cleaner, an oven, a microwave oven, a washing machine, an air cleaner, a set-top box, a home automation control panel, a security control panel, a TV box (for example, Samsung Home-Sync®, Apple TV®, or Goggle TV®), a game console (for example, Xbox®, PlayStation®), an electronic dictionary, an electronic key, a camcorder, or an electronic album.

The electronic device may also include at least one of various medical machines (for example, various portable medical measurement devices (such as a glucose monitor, a heart rate monitor, a blood pressure measuring device, or a thermometer), Magnetic Resonance Angiography (MRA), Magnetic Resonance Imaging (MRI), Computerized Tomography (CT), a tomograph, an ultrasound machine, and the like), a navigation device, a Global Positioning System (GPS) receiver, an Event Data Recorder (EDR), a Flight Data Recorder (FDR), an automotive infotainment device, electronic equipment for ship (such as navigation equipment for ship, a gyro compass, and the like), avionics, a security device, a head unit for vehicles, an industrial or home robot, an automatic teller machine (ATM) of a financial institution, point of sales (POS) device of a store, or Internet of Things (for example, a lamp, various sensors, an electric or gas meter, a sprinkler, a fire alarm, a thermostat, a streetlamp, a toaster, an exercising machine, a hot water tank, a heater, a boiler, etc.).

The electronic device may further include at least one of a part of furniture or a building/a structure, an electronic board, an electronic signature receiving device, a projector, and various measurement devices (such as devices for measuring water, power, gas, radio waves, and the like). The electronic device may be one or a combination of one or more of the above-mentioned devices. In addition, the electronic device may be a flexible electronic device. In addition, the electronic device according to the present disclosure is not limited to the above-mentioned devices, and may include new electronic devices according to the development of new technologies.

Hereinafter, an electronic device according to various embodiments of the present disclosure will be explained with reference to the accompanying drawings. The term "user" as used herein may refer to a person who uses the electronic device or a device that uses the electronic device (for example, an artificial intelligence electronic device).

FIG. 1 is a diagram illustrating a network environment 100 including an electronic device 101, according to an embodiment of the present disclosure.

The electronic device 101 includes a bus 110, a processor 120, a memory 130, an input/output interface 140, a display 150, and a communication interface 160. At least one of the components of the electronic device 101 may be omitted, or other components may be additionally included in the electronic device 101.

The bus 110 may include, for example, a circuit for connecting the elements 110-160 to each other and for transferring communication (for example, a control message and/or data) between the elements.

The processor 120 may include one or more of a Central Processing Unit (CPU), an Application Processor (AP), and a Communication Processor (CP). The processor 120 may execute calculations or data processing related to control and/or communication with at least one other element of the electronic device 101.

The memory 130 may include a volatile memory and/or a non-volatile memory. The memory 130 may store, for example, commands or data related to at least one other component of the electronic device 101. The memory 130 may store software and/or a program. The program may include, for example, a kernel 131, middleware 132, an Application Programming Interface (API) 133 and/or an application program (or "application") 134. At least some of the kernel 131, the middle 132, and the API 133 may be referred to as an Operating System (OS).

The kernel 131 may control or manage system resources (for example, the bus 110, the processor 120, the memory 130, and the like) used for executing an operation or function implemented by the other programs (for example, the middleware 132, the API 133, or the application program 134). Furthermore, the kernel 131 may provide an interface through which the middleware 132, the API 133, or the application program 134 may access individual components of the electronic device 101 to control or manage system resources.

The middleware 132 may serve as a relay for allowing the API 133 or the application programs 134 to communicate with the kernel 131 to exchange data. Further, in relation to requests for an operation received from the application program 134, the middleware 132 may control (for example, scheduling or load-balancing) the requests for the operation using, for example, a method of determining a sequence for using system resources (for example, the bus 110, the processor 120, the memory 130, or the like) of the electronic device 101 with respect to at least one application of the application program 134.

The API 133 is an interface by which the applications 134 control functions provided from the kernel 131 or the middleware 132, and may include, for example, at least one interface or function (for example, instructions) for file control, window control, image processing, or text control.

A display processing program 135 may include a processor that is configured to measure a temperature of at least one part of the electronic device 101 through a temperature sensor 170, determine a cancellation algorithm corresponding to the measured temperature, and display an image on the display 150 based on the determined cancellation algorithm.

The display processing program 135 is configured to correct a distortion of an image displayed on the display 150 based on the cancellation algorithm and apply a reverse bias, which corresponds to the cancellation algorithm, to the display 150.

The display processing program 135 is configured to select the cancellation algorithm from at least two cancellation algorithms which correspond to a respective specific temperature range in the electronic device 101.

The display processing program 135 is configured to measure a temperature of the display 150 of the electronic device 101. Moreover, the display processing program 135 is configured to measure a second temperature of at least one second part of the electronic device 101, determine a second cancellation algorithm corresponding to the measured second temperature, and display an image based on the second cancellation algorithm.

The display processing program 135 is configured to apply another cancellation algorithm which is determined after releasing a previously or already applied cancellation algorithm.

The display processing program 135 is configured to measure a temperature of the at least a one part of the electronic device 101 when a voltage imbalance of the display 150 is detected. Furthermore, the display processing program 135 is configured to measure a temperature of the at least one part of the electronic device 101 when a distortion occurs on the image due to least one of a determination of a voltage imbalance, which occurs in the display 150, and a determination of a voltage conversion speed of the display 150.

The aforementioned functions of the display processing program 135 are described in greater detail below with reference to FIGS. 3-11.

The input/output interface 140 may serve as an interface that may transfer instructions or data, which is input from a user or another external device, to another component(s) of the electronic device 101. Further, the input/output interface 140 may output instructions or data received from another component(s) of the electronic device 101 to a user or another external device.

The display 150 may include, for example, a Liquid Crystal Display (LCD), a Light Emitting Diode (LED) display, an Organic Light Emitting Diode (OLED) display, a Micro Electro Mechanical System (MEMS) display, or an electronic paper display. The display 150 may display various types of contents (for example, text, images, videos, icons, or symbols) to users. The display 150 may include a touch screen and receive, for example, a touch input, a gesture input, a proximity input, or a hovering input using an electronic pen or a user's body part.

The communication interface 160 may establish communication between the electronic device 101 and an external device (for example, a first electronic device 102, a second electronic device 104, or a server 106). For example, the communication interface 160 may be connected to a network 162 through wireless or wired communication to communicate with the aforementioned external devices.

The wireless communication may use, for example, at least one of Long Term Evolution (LTE), LTE-Advance (LTE-A), Code Division Multiple Access (CDMA), Wideband CDMA (WCDMA), Universal Mobile Telecommunications System (UMTS), Wireless Broadband (WiBro), and Global System for Mobile Communications (GSM), for example, as a cellular communication protocol. The wired communication may include, for example, at least one of a Universal Serial Bus (USB), a High Definition Multimedia Interface (HDMI), Recommended Standard 232 (RS-232), and a Plain Old Telephone Service (POTS). The network 162 may include communication networks such as a computer network (for example, a Local Area Network (LAN) or a Wideband Area Network (WAN)), the Internet, and a telephone network.

Each of the first and second external electronic devices 102 and 104 may be a device which is the same as or different type from the electronic device 101. The server 106 may include a group of one or more servers. All or some of the operations performed by the electronic device 101 may be performed by another electronic device or a plurality of the electronic devices 102, 104 or the server 106.

When the electronic device 101 has to perform any function or service automatically or in response to a request, the electronic device 101 may request the electronic devices 102 or 104 or the server 106 to perform at least some functions related to the function or service, instead of executing the function or service by itself. The electronic devices 102 or 104 or the server 106 may carry out the requested function or the additional function and transfer the result, obtained by carrying out the function, to the electronic device 101. The electronic device 101 may provide the requested functions or services based on the received result as it is or after additionally processing the received result. To achieve this, for example, cloud computing, distributed computing, or client-server computing technology may be used.

The temperature sensor 170 is configured to measure a temperature of the electronic device 101, such as an internal temperature of the electronic device 101, an external temperature of the electronic device 101, and a temperature of a battery included in the electronic device 101.

Further, the temperature sensor 170 may be used in an operation for resolving an voltage imbalance of the display 150. To this end, the temperature sensor 170 may be embodied by at least one of a thermistor, a thermopile, a Resistance Temperature Diode (RTD), a semiconductor, a surface mount type sensor, a platinum wire, a conductive polymer, an optical fiber, a fluorescence sensor, an Infrared (IR) sensor, and a heat flux sensor, or other suitable sensor.

The temperature sensor 170 may be included in a block (or a module) of at least one device (e.g., a processor 120 and a display 150) of the electronic device 101, or the temperature sensor 170 may be a separate component within the electronic device 101 and operatively connected, via the bus 110, to the other components of the electronic device 101, as shown in FIG. 1. The temperature sensor 170 may be included within a battery of the electronic device and may measure a temperature of the battery and surroundings thereof. The temperature sensor 170 is configured to measure an internal temperature of the electronic device 101, by being mounted as an independent component within the electronic device 101, and transfers the measured temperature to the processor 120. In accordance with the present disclosure, the aforementioned temperatures which can be measured in the electronic device 101 may be used to determine a temperature of the display 150.

Figure 2:
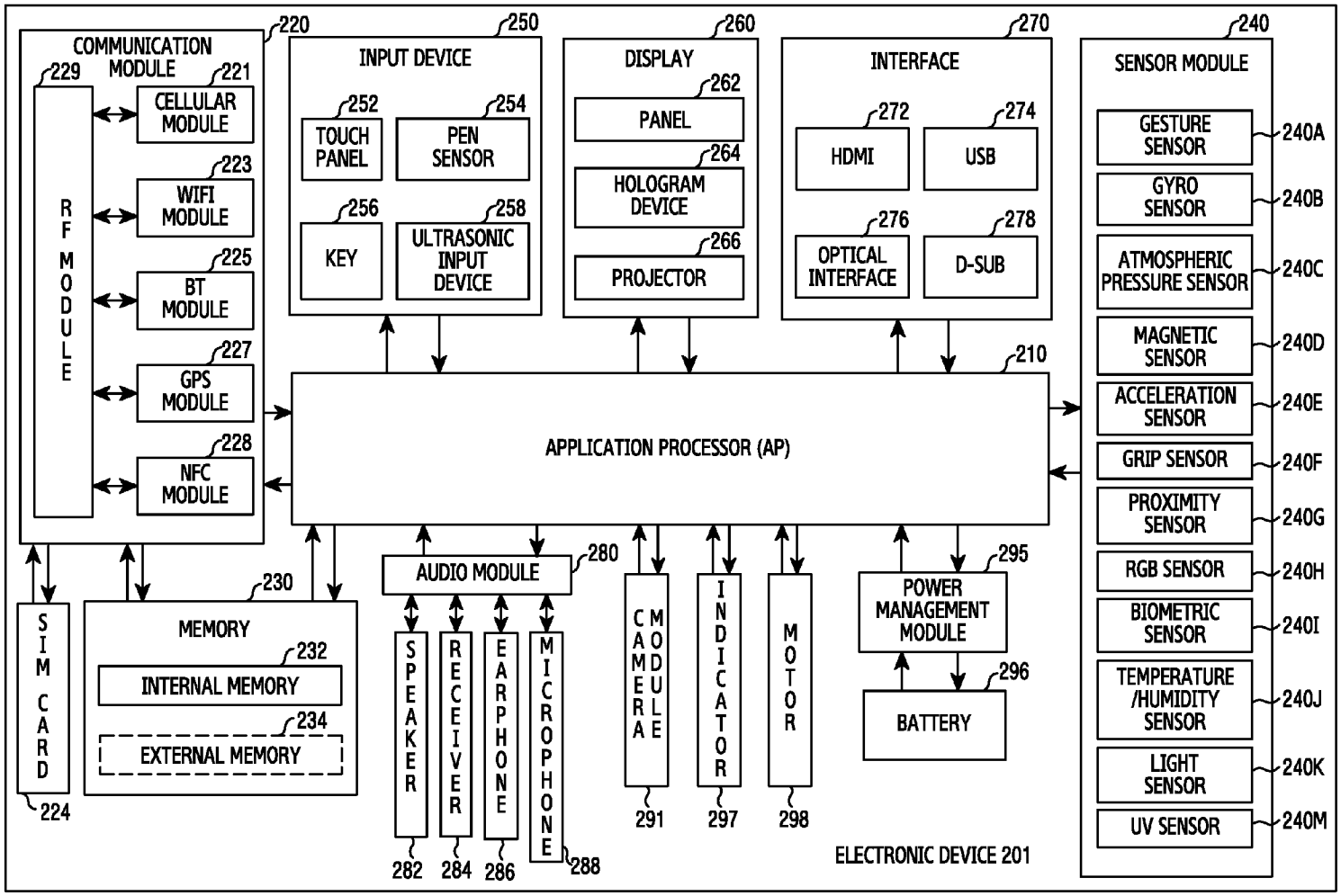
FIG. 2 is a diagram of an electronic device, according to an embodiment of the present disclosure.

FIG. 2 is a diagram of an electronic device 201, according to an embodiment of the present disclosure.

The electronic device 201 may include, for example, all or some of the components of the electronic device 101 illustrated in FIG. 1. The electronic device 201 includes at least one Application Processor (AP) 210, a communication module 220, a Subscriber Identification Module (SIM) card 224, a memory 230, a sensor module 240, an input device 250, a display 260, an interface 270, an audio module 280, a camera module 291, a power management module 295, a battery 296, an indicator 297, and a motor 298.

The AP 210 may control a plurality of hardware or software components connected thereto by driving an operating system or an application program, and may perform a variety of data processing and calculations. The AP 210 may be embodied as, for example, a System on Chip (SoC). The AP 210 may further include a Graphic Processing Unit (GPU) and/or an image signal processor. The AP 210 may also include at least some (for example, a cellular module 221) of the components illustrated in FIG. 2. The AP 210 may load instructions or data, received from at least one other component (for example, a non-volatile memory), in a volatile memory to process the loaded instructions or data, and may store various types of data in a non-volatile memory.

The communication module 220 may have a configuration equal or similar to the communication interface 160 of FIG. 1. The communication module 220 may include, for example, the cellular module 221, a Wireless-Fidelity (Wi-Fi) module 223, a Bluetooth (BT) module 225, a Global Positioning System (GPS) module 227, an Near Field Communication (NFC) module 228, and a Radio Frequency (RF) module 229.

The cellular module 221 may provide a voice call, video call, text message services, or Internet services through, for example, a communication network. The cellular module 221 may identify and authenticate electronic devices 201 within a communication network by using a subscriber identification module (SIM) card 224. The cellular module 221 may perform at least some of functions that may be provided by the AP 210. The cellular module 221 may include a communication processor (CP).

The Wi-Fi module 223, the BT module 225, the GPS module 227, and the NFC module 228 may include, for example, a processor for processing data transmitted/received through the corresponding module. At least some (for example, two or more) of the cellular module 221, the Wi-Fi module 223, the BT module 225, the GPS module 227, and the NFC module 228 may be included in one Integrated Chip (IC) or IC package.

The RF module 229 may transmit/receive, for example, a communication signal (for example, an RF signal). The RF module 229 may include, for example, a transceiver, a Power Amp Module (PAM), a frequency filter, a Low Noise Amplifier (LNA), or an antenna. At least one of the cellular module 221, the Wi-Fi module 223, the BT module 225, the GPS module 227, and the NFC module 228 may transmit/receive an RF signal through a separate RF module.

The SIM card 224 may include, for example, an embedded SIM, and may further include unique identification information (for example, an Integrated Circuit Card Identifier (ICCID)) or subscriber information (for example, International Mobile Subscriber Identity (IMSI)).

The memory 230 may include, for example, an internal memory 232 or an external memory 234. The internal memory 232 may include at least one of a volatile memory (for example, a Dynamic Random Access Memory (DRAM), a Static RAM (SRAM), a Synchronous Dynamic RAM (SDRAM), and the like) and a non-volatile memory (for example, a One Time Programmable Read Only Memory (OTPROM), a Programmable ROM (PROM), an Erasable and Programmable ROM (EPROM), an Electrically Erasable and Programmable ROM (EEPROM), a mask ROM, a flash ROM, a flash memory (for example, a NAND flash memory or a NOR flash memory), a hard disk drive, a Solid State Drive (SSD), and the like).

The external memory 234 may further include a flash drive, for example, a Compact Flash (CF), a Secure Digital (SD), a Micro Secure Digital (Micro-SD), a Mini Secure Digital (Mini-SD), an extreme Digital (xD), a memory stick, or the like. The external memory 234 may be functionally and/or physically connected to the electronic device 201 through various interfaces.

The sensor module 240 may measure, for example, a physical quantity or detect an operation state of the electronic device 201, and may convert the measured or detected information to an electrical signal. The sensor module 240 may include at least one of, for example, a gesture sensor 240*a*, a gyro sensor 240B, an atmospheric pressure sensor 240C, a magnetic sensor 240D, an acceleration sensor 240E, a grip sensor 240F, a proximity sensor 240G, a color sensor 240H (for example, a Red/Green/Blue (RGB) sensor), a bio-sensor 240I, a temperature/humidity sensor 240J, a light sensor (e.g., an illumination sensor 240K), and an Ultra Violet (UV) sensor 240M. Additionally or alternatively, the sensor module 240 may include, for example, an E-nose sensor, an Electromyography (EMG) sensor, an Electroencephalogram (EEG) sensor, an Electrocardiogram (ECG) sensor, an IR sensor, an iris scanner, and/or a fingerprint sensor. The sensor module 240 may further include a control circuit for controlling at least one sensor included therein. The electronic device 201 may further include a processor that is configured, as a part of the AP 210 or a separate component from the AP 210, to control the sensor module 240, thereby controlling the sensor module 240 while the AP 210 is in a sleep mode.

The input device 250 may include, for example, a touch panel 252, a (digital) pen sensor 254, a key 256, or an ultrasonic input device 258. The touch panel 252 may use at least one of, for example, a capacitive type, a resistive type, an infrared type, and an ultrasonic type methods. The touch panel 252 may further include a control circuit. The touch panel 252 may further include a tactile layer, and provide a tactile reaction to a user.

The (digital) pen sensor 254 may include, for example, a recognition sheet which is a part of the touch panel or a separate recognition sheet. The key 256 may include, for example, a physical button, an optical key or a keypad. The ultrasonic input unit 258 may input data through an input means that generates an ultrasonic signal, and the electronic device 201 identify data by detecting a sound wave with a microphone 288.

The display 260 may include a panel 262, a hologram device 264, or a projector 266. The panel 262 may include a configuration that is identical or similar to the display 150 illustrated in FIG. 1. The panel 262 may be embodied to be, for example, flexible, transparent, or wearable. The panel 262 may also be configured to be integrated with the touch panel 252 as a single module. The hologram device 264 may show a stereoscopic image in the air by using interference of light. The projector 266 may project light onto a screen to display an image. For example, the screen may be located inside or outside the electronic device 201. The display 260 may further include a control circuit for controlling the panel 262, the hologram device 264, or the projector 266.

The interface 270 may include, for example, a HDMI 272, a USB 274, an optical interface 276, or a D-subminiature (D-sub) 278. The interface 270 may be included in, for example, the communication interface 160 illustrated in FIG. 1. Additionally or alternatively, the interface 270 may include, for example, a Mobile High-definition Link (MHL) interface, a Secure Digital (SD) card/Multi-Media Card (MMC) interface, or an Infrared Data Association (IrDA) standard interface.

For example, the audio module 280 may convert a sound and an electrical signal bi-directionally. At least some components of the audio module 280 may be included in, for example, the input/output interface 140 illustrated in FIG. 1. The audio module 280 may process sound information input or output through, for example, the speaker 282, a receiver 284, earphones 286, the microphone 288, or the like.

The camera module 291 may capture, for example, a still image or a dynamic image and, may include one or more image sensors (for example, a front sensor or a back sensor), a lens, an Image Signal Processor (ISP), or a flash (for example, an LED or a xenon lamp).

The power management module 295 may manage, for example, power of the electronic device 201. The power management module 295 may include a Power Management Integrated Circuit (PMIC), a charger Integrated Circuit (IC), or a battery gauge. The PMIC may use a wired and/or wireless charging scheme. Examples of the wireless charging method may include, for example, a magnetic resonance scheme, a magnetic induction scheme, an electromagnetic wave scheme, and the like. Further, the wireless charging method may further include additional circuits (for example, a coil loop, a resonance circuit, a rectifier, etc.) for wireless charging. The battery gauge may measure, for example, the remaining amount of battery, a charging voltage, current, or temperature. The battery 296 may include, for example, a rechargeable battery and/or a solar battery.

The indicator 297 may indicate a particular status of the electronic device 201 or a part thereof (for example, the AP 210), for example, a booting status, a message status, a charging status, or the like. The motor 298 may convert an electrical signal into mechanical vibrations, and may generate a vibration or haptic effect. Although not illustrated, the electronic device 201 may include a processing device (for example, a GPU) for supporting mobile TV. The processing device for supporting mobile TV may process media data according to a standard of Digital Multimedia Broadcasting (DMB), Digital Video Broadcasting (DVB), media flow or the like.

Each of the components of the electronic device may be implemented by one or more components and the name of the corresponding component may vary depending on a type of the electronic device 201. The electronic device 201 may include at least one of the above-described elements. Some of the above-described elements may be omitted from the electronic device 201, or the electronic device 201 may further include additional elements. Further, some of the elements of the electronic device 201 may be coupled to form a single entity while performing the same functions as those of the corresponding elements before the coupling.

Figures 3A, 3B, 3C:
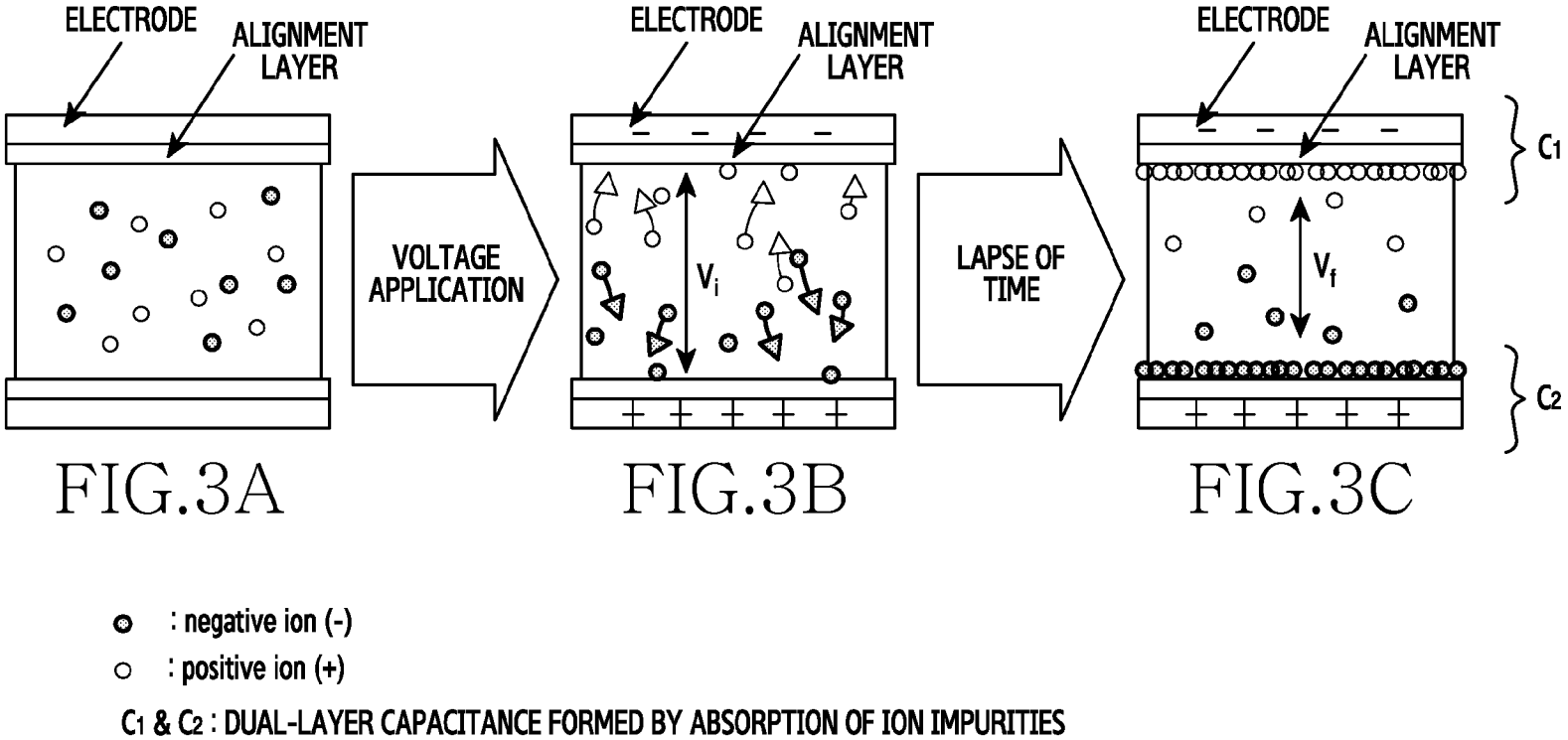
FIGS. 3A-3C are diagrams illustrating an effect which occurs by applying a voltage to a display in an electronic device, according to an embodiment of the present disclosure.

FIGS. 3A-3C are diagrams illustrating an effect which occurs by applying a voltage to a display, e.g., the displays 150/260, in an electronic device, e.g., electronic devices 101/201, according to an embodiment of the present disclosure. For illustrative purposes, the display 150 and the electronic device 101 are described in conjunction with the remaining FIGs.

In displaying an image on the display 150 including a liquid crystal (e.g., a display panel in a LCD scheme), the electronic device 101 can express a designated color depending on a phase change (or an array of the liquid crystal) of the liquid crystal included in the display when a voltage is applied. The electronic device 101 may improve a phase difference of the liquid crystal corresponding to the designated color by controlling a voltage applied to the display 150. The electronic device 101 applies a voltage to a pixel unit of the display 150 so as to make a control to express a color corresponding to the voltage applied in the pixel unit.

FIG. 3A illustrates a display configuration of the display 150. When a voltage is applied to the positive and negative poles (e.g., upper/lower electrodes) in the display 150 of the electronic device 101, a phase of a liquid crystal can change and an ion moving in electrode directions of the positive and negative poles is generated. When a voltage is applied to an electrode of the display 150, a (+) ion can move in a direction to which a (−) polarity is applied and a (−) ion can move in a direction to which a (+) polarity is applied, as shown in FIG. 3B.

The ions moving to each polarity may be accumulated (e.g., the ions can be located in an alignment layer by moving in upper/lower electrode directions) over time, and an imbalance of the voltage supplied to the display 150 may be identified by the accumulated ions (e.g., ion impurities). When a voltage is applied to the display 150 of the electronic device 101, the ions are accumulated to the upper/lower electrodes so that a balance of a voltage supplied through an electrode may be broken or disrupted as shown in FIG. 3C. In applying a voltage to the display 150, the electronic device 101 does not apply a voltage of a polarity (Direct Current (DC)) fixed to each of the upper/lower electrode and applies a voltage by intersecting a polarity such as an Alternating Current (AC).

The display 150 of the electronic device 101 alternately applies an AC voltage to the upper/lower electrode of the display 150 such that an effect in which the accumulated ions are stuck can be prevented. However, the accumulated ions may still exist in each electrode of the display 150 and an imbalance of a voltage supplied by the upper/lower electrode of the display 150 may occur.

A difference (e.g., a DC BIAS, hereinafter, a phase difference or a voltage difference) between a voltage provided in the (+) polarity and a voltage provided in the (−) polarity may occur due to an imbalance of the voltage supplied to each of the upper/lower electrodes of the display 150. The voltage difference due to the voltage imbalance occurring in the display 150 may move a reference point of an AC voltage provided to the display 150. For example, when a voltage difference of 0.5 V occurs in the (+) polarity of the display 150 in a state in which an AC voltage of 1 V is provided to the display 150, even though the electronic device 101 provides a value of 1 V to the (+) polarity and (−) polarity, a voltage having a value of 1.5 V of the (+) polarity and 0.5 V of the (−) polarity may be measured at the display.

When time elapses in a state in which the provided voltage difference occurs and the provided voltage difference is maintained as described above, even when an application of the voltage is blocked, a case in which the ions accumulated toward the alignment layer do not return to a position before the voltage is applied may occur, and the remaining ions may be displayed on the display 150 in the form of an afterimage.

In displaying an image on the display 150 of the electronic device 101, the afterimage may be generated due to the remaining voltage, which had been provided to display an image on the display 150 of the electronic device 101, in the display 150 without being canceled or removed in an operation controlled in accordance with a change of the image. When the electronic device 101 blocks the application of the voltage to the display 150, at least a part of the voltage imbalance occurring in the display 150 may not be completely canceled and removed, but may remain for a predetermined time interval. The remaining voltage may be expressed as an afterimage on the display 150. The voltage remaining on the display 150 may be an effect due to ion impurities accumulated by the voltage imbalance of the upper/lower electrodes.

Figure 4:
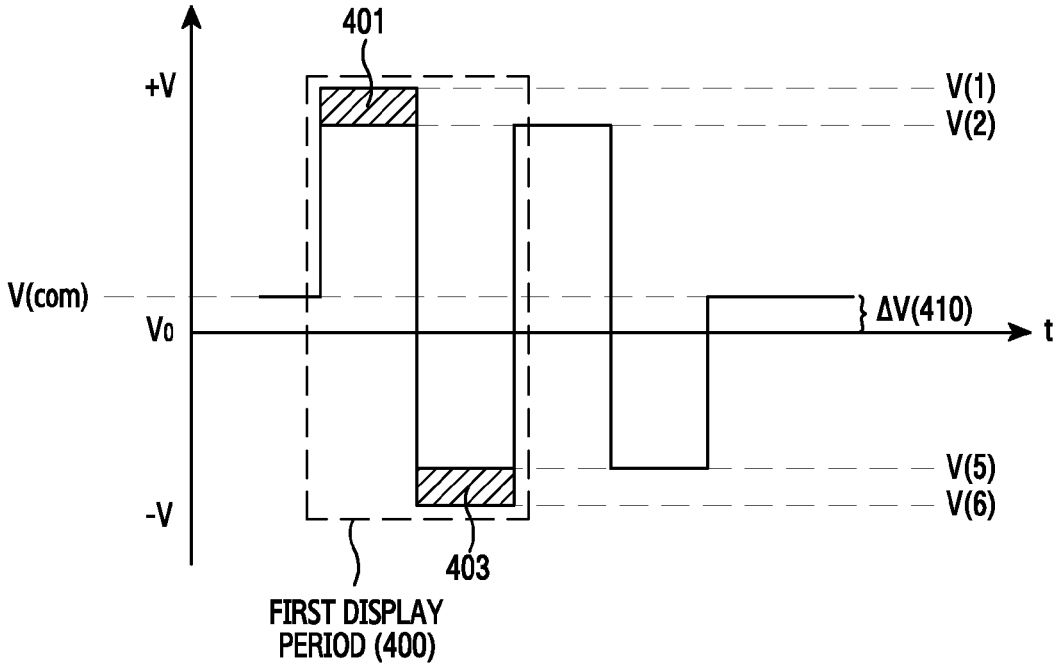
FIG. 4 is a diagram illustrating an effect which occurs due to a voltage imbalance of a display in an electronic device, according to an embodiment of the present disclosure.

FIG. 4 is a diagram illustrating an effect which occurs due to a voltage imbalance of the display 150 in the electronic device 101, according to an embodiment of the present disclosure.

When displaying an image on the display 150, the electronic device 101 may apply, to an electrode of a corresponding pixel, a voltage designated according to gradation (e.g., a condition such as color and brightness, hereinafter image information) corresponding to a specific pixel of the image. For example, referring to a first display cycle 400 in FIG. 4, the electronic device 101 may apply a V(2) voltage to a (+) polarity in displaying image information to a pixel corresponding to the first display cycle 400. The electronic device 101 may apply an AC voltage to the display 150 so that a V(6) voltage can be applied to a (−) polarity. A pixel in which the image information of the first display cycle is displayed on the display 150 of the electronic device 101 may be in a state in which a voltage difference by a delta V occurs due to the accumulated ions.

The voltage difference occurring in the first display cycle may be a voltage difference by delta V410 of the (+) polarity. When a specific voltage is applied to a corresponding pixel by the electronic device 101, the voltage difference by delta V410 of the (+) polarity can express image information corresponding to a voltage in a state in which the voltage difference by delta V410 of the (+) polarity is added to the specific voltage. For example, when a V(2) voltage of the (+) electrode is applied to a specific pixel in the first display cycle of the display 150, the electronic device 101 may supply a V(6) voltage of the (−) polarity having the same size of the V(2) voltage by applying the AC voltage. In this instance, in a corresponding pixel in a state of the voltage difference by the delta V410 of the (+) polarity, image information brighter than V(2) voltage may be expressed in accordance with a voltage (e.g., V(1) voltage) by delta V410 of a V(2) of the (+) polarity in a case of the (+) polarity, and image information darker than V(6) voltage may be expressed in accordance with a voltage (e.g., V(5) voltage) by delta V410 of a V(6) of the (+) polarity in a case of the (−) polarity. Therefore, in the corresponding pixel, it is possible to identify that a distortion in a display of the image information occurs in a first display period expressing an identical image, and a difference (e.g., 401 and/or 403) of the distorted and displayed image information may be expressed on the display 150 as an afterimage. Further, the corresponding pixel of the display 150 may not display image information in a state in which an application of the voltage is blocked, that is, a V0 state, but image information in a state in which a voltage by delta V410 of the (+) polarity is applied or an afterimage therefrom.

A voltage difference occurring based on a supply of a voltage may occur corresponding to a temperature of the display 150. For example, a voltage difference occurring in the first display cycle in a room temperature state (e.g., 25 degrees Celsius) may be larger than a voltage difference occurring in the first display cycle in a high temperature state (e.g., 30 degrees Celsius or more). When a larger voltage difference occurs while displaying an image on the display 150 by the electronic device 101, a distortion of an image intensifies and the afterimage may be more accurately determined. For example, an internal temperature of the electronic device 101 may be used when the temperature sensor 170 is included in the electronic device 101 such that the temperature of the display 150 and/or the internal temperature of the electronic device 101 can be used to determine a voltage difference occurring in the display 150 during the first display cycle.

The electronic device 101 may perform a cancellation algorithm for removing a distortion of image information (or a distortion of an image) and/or an afterimage displayed on the display 150. The electronic device 101 may use a method for applying a reverse voltage equal to a voltage difference occurring between the (+) polarity and the (−) polarity in order to remove the distortion and/or afterimage of image information displayed on the display 150. For example, when the voltage difference by the delta V410 of the (+) polarity occurs, in the first display period, the electronic device 101 may express image information in a state of applying a voltage by delta V of the (−) polarity.

Figure 5A:
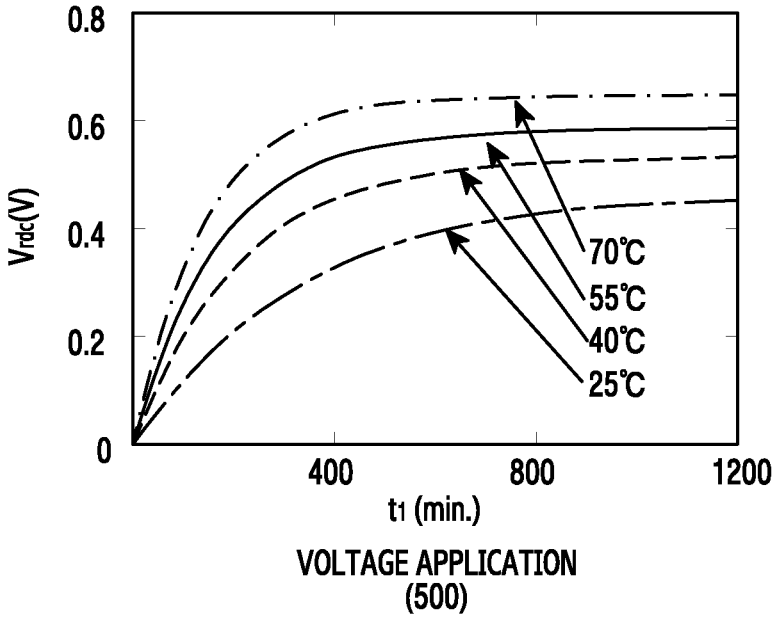
FIGS. 5A and 5B are diagrams illustrating a difference in a voltage imbalance which occurs due to a temperature of an electronic device, according to an embodiment of the present disclosure.
Figure 5B:
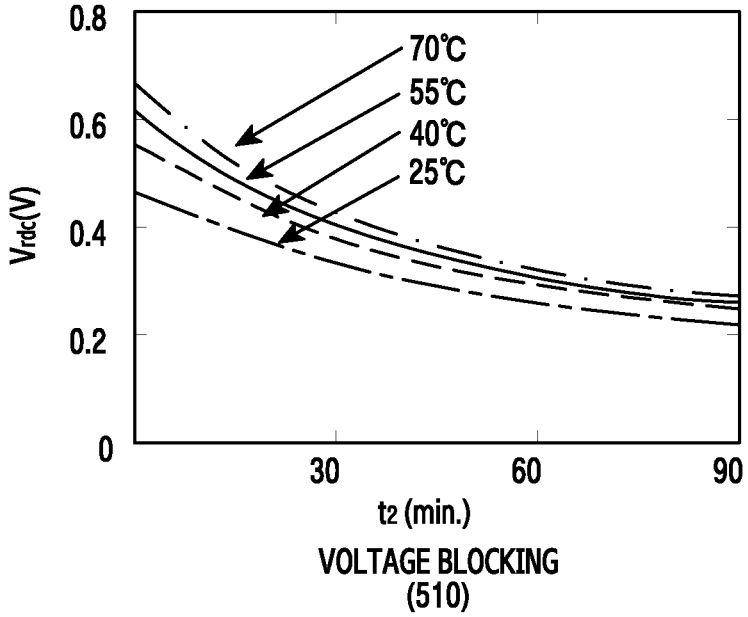

FIGS. 5A and 5B are diagrams illustrating a difference in a voltage imbalance which occurs due to a temperature of the electronic device 101, according to an embodiment of the present disclosure.

In displaying an image on the display 150, the electronic device 101 applies a voltage in accordance with image information corresponding to each pixel to the corresponding pixel so that the image can be displayed on the display 150. The display 150 of the electronic device 101 may generate heat based on a provided voltage and accumulated ion impurities and may increase a temperature in a specific temperature range when an operation of displaying an image on the display 150 of the electronic device 101 is maintained.

When the voltage imbalance occurs, the display 150, under the control of the processor 120, of the electronic device 101 may change a voltage difference caused by a voltage imbalance occurring due to the change of the temperature. The voltage difference occurring in the display 150 of the electronic device 101 may increase as the temperature rises. For example, referring to the voltage application graph 500 of FIG. 5A, when an operation of displaying an image on the display 150 is maintained, it is possible to identify when a voltage difference by the voltage imbalance due to the specific temperature is relatively large. A residual DC voltage (Vrdc) may represent a voltage difference due to a voltage imbalance.

The generated voltage difference may cause an accumulation of ion impurities on the upper/lower electrode of the display 150 and may thus be expressed as an afterimage on the display 150. The expressed or displayed afterimage may disappear or fade in accordance with a lapse of time after the voltage is blocked to the display 150 of the electronic device 101. For example, the electronic device 101 may block a voltage provided to the display 150 so that a display of an image can be stopped. When the remaining voltage exists on the display 150, the remaining voltage may decrease or disappear in accordance with the lapse of time. At least a part of the ion impurities accumulated on the upper/lower electrodes of the display 150 may be spread or rearranged on a liquid crystal as the remaining voltage decreases and a part of the ion impurities may be stuck within the liquid crystal and be not rearranged. When the ion impurities are rearranged within the liquid crystal, the afterimage which has been expressed on the display 150 may fade or disappear.

Referring to a voltage block graph 510 of FIG. 5B, when the voltage provided to the display 150 is blocked, a change of the remaining voltage in accordance with the lapse of time in a specific temperature may be identified. For example, in a case where the voltage difference by the voltage imbalance occurs in the display 150 of the electronic device 101, when the electronic device 101 blocks a voltage provided to the display 150, at least a part of the voltage difference may exist as the remaining voltage on the display 150 and may decrease in accordance with the lapse of time. The remaining voltage, in a state in which the voltage provided to the display 150 is blocked, may be measured to be relatively larger in a case in which the temperature is relatively high than that in a case in which a temperature is relatively low. Therefore, a clearer afterimage may be expressed on the display 150. Further, the remaining voltage decreases in accordance with the lapse of time and the afterimage displayed on the display 150 may fade as the remaining voltage decreases. In this instance, the time interval required for the remaining voltage existing on the display 150 to decrease to a voltage (e.g., 0.1V) of a specific level may be longer in the case in which a temperature is relatively high than that in the case in which a temperature is relatively low. Herein, when the electronic device 101 blocks the voltage provided to the display 150, a condition for the lapse of time may be a natural cooling condition in a state in which a specific cooling operation is not performed in the displayed 150 and at a specific temperature.

Figure 6A:
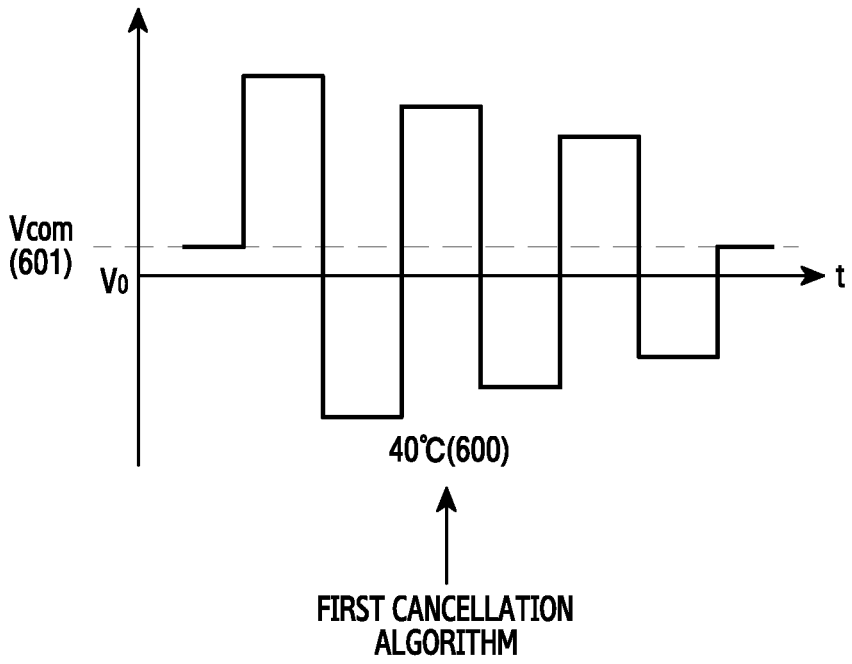
FIGS. 6A and 6B are diagrams illustrating a cancellation algorithm of a voltage imbalance in an operation of a display in an electronic device, according to an embodiment of the present disclosure.
Figure 6B:
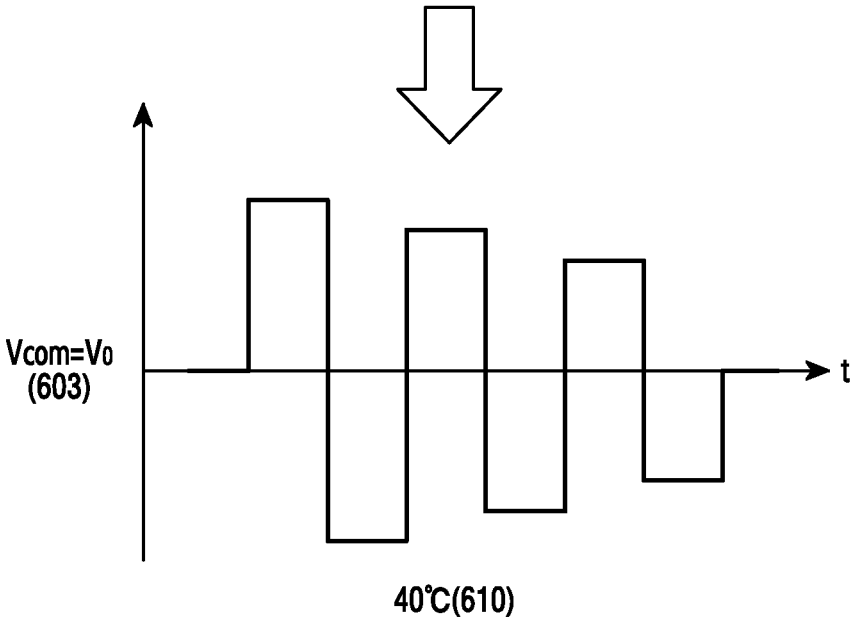

FIGS. 6A and 6B are diagrams illustrating a cancellation algorithm of a voltage imbalance in an operation of the display 150 in the electronic device 101, according to an embodiment of the present disclosure.

When an image is displayed on the display 150, the electronic device 101 can apply a cancellation algorithm to prevent an effect in which image information displayed on the display 150 is distorted by the imbalance of the voltage. The electronic device 101 may include at least one cancellation algorithm in a storage device, e.g., the memory 130, of the electronic device 101. Further, the electronic device 101 may include a cancellation algorithm in a storage device of at least one processor 120. In displaying a cancellation algorithm, the electronic device 101 may include two or more cancellation algorithms such as a first cancellation algorithm and second cancellation algorithm corresponding to a designated temperature range.

The electronic device 101 may measure a temperature of the display 150 in displaying an image on the display 150. The electronic device 101 may identify whether the measured internal temperature is within a specific temperature range. For example, when it is determined that a specific temperature is included in a first temperature range (e.g., less than 70 degrees), the electronic device 101 may call or request a first cancellation algorithm corresponding to the first temperature range.

The electronic device 101 may apply the cancellation algorithm to an operation of displaying an image of the display 150. For example, referring to a graph 600 of FIG. 6A, the display 150 of the electronic device 101 may display an image in a state of where the temperature of the display 150 is 40 degrees Celsius. When the electronic device 101 does not apply the cancellation algorithm during the operation of displaying an image of the display 150, a voltage imbalance may occur and an afterimage of the display 150 caused by a voltage difference may appear due to the voltage imbalance and/or ion impurities of the display 150, due to the ion impurities accumulated on the upper/lower electrodes of the display 150.

The electronic device 101 may measure a temperature of the display 150. The electronic device 101 may determine if a measured temperature of the display 150 is within a specified temperature range. For example, when the measured temperature is within a first temperature range or group, the electronic device 101 may call a first cancellation algorithm corresponding to the first temperature range. The electronic device 101 may apply the first cancellation algorithm to an operation of displaying an image of the display 150 of the electronic device 101.

Also, in displaying an image of the display 150 as shown in a graph 610 of FIG. 6B, the electronic device 101 may correct a distortion of image information occurring due to the voltage imbalance. In correcting the distortion of the image information displayed on the display 150 through the first cancellation algorithm, the electronic device 101 may use a method of resolving the voltage imbalance occurring in the display 150 as shown in graphs 600 and 610 of FIGS. 6A and 6B, respectively. For example, in displaying an image on the display 150, the electronic device 101 may apply a reverse bias of 0.5V to the display 150 when the voltage difference occurring due to the voltage imbalance is 0.5V. For example, the electronic device 101 may apply a correction voltage of 0.5V of a (−) polarity to the display 150 when the voltage difference occurring due to the voltage imbalance of the display 150 is 0.5V of a (+) polarity. In the method of determining the voltage difference occurring due to the voltage imbalance, a temperature of the display 150 is measured and compared to a database (e.g., a data table) of the electronic device 101 such that the voltage difference may be determined as a voltage difference designated in a specific temperature range matched for the measured temperature.

When the image information is distorted, the electronic device 101 may determine a voltage difference designated in the data table based on a degree of the distortion of the image information. The electronic device 101 may determine a voltage difference by directly outputting a voltage output to the display 150.

When the electronic device 101 displays an image in a state in which the temperature of the display 150 is, for example, 40 degrees Celsius, a voltage imbalance of Vcom 601 may occur. The electronic device 101 may determine a cancellation algorithm (e.g., a first cancellation algorithm) corresponding to a specific temperature range to which the measured temperature (e.g., 40 degrees Celsius) belongs and compares the measure temperature to temperatures provided in the database. The electronic device 101 provides a correction voltage designated based on the first cancellation algorithm to the display 150 so that a voltage difference occurring in the display 150 can be cancelled. The electronic device 101 can remove an afterimage expressed in the display 150 because the voltage imbalance of the display has been resolved.

Figure 7A:
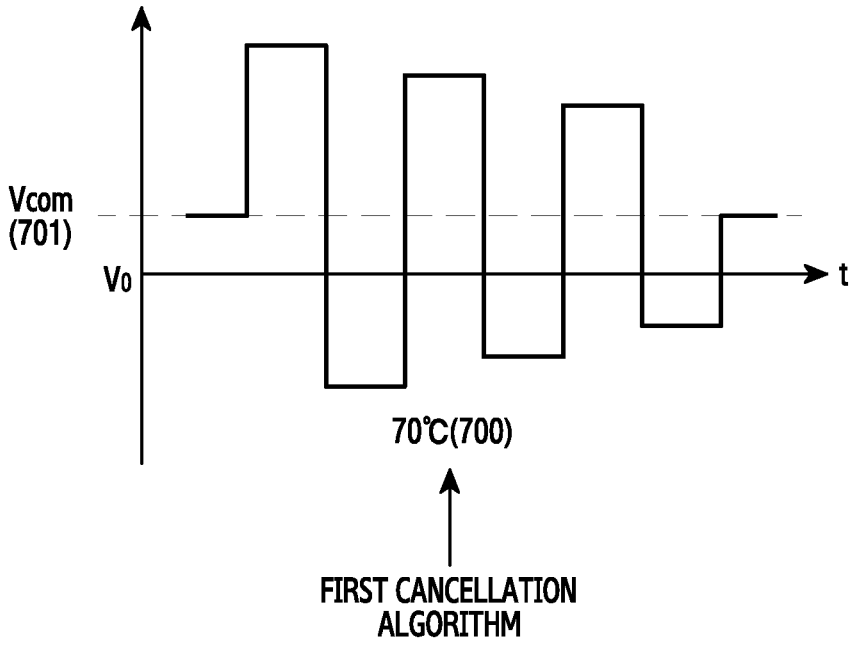
FIGS. 7A and 7B are diagrams illustrating a cancellation algorithm of a voltage imbalance in an operation of a display in an electronic device, according to an embodiment of the present disclosure.
Figure 7B:
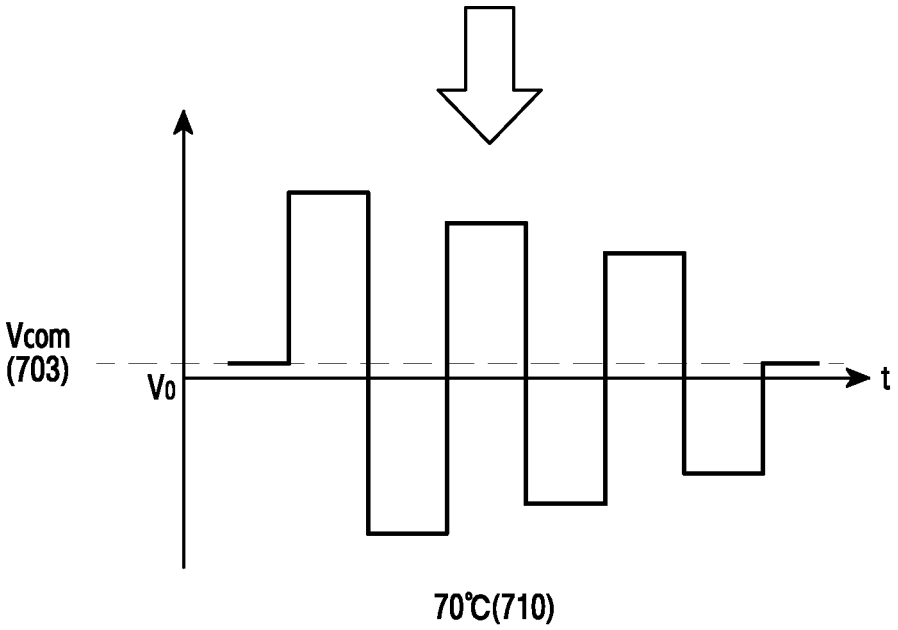

FIGS. 7A and 7B are diagrams illustrating a cancellation algorithm of a voltage imbalance in an operation of the display 150 in the electronic device 101, according to an embodiment of the present disclosure.

In using the display 150, the electronic device 101 may generate a change of a voltage difference occurring in the display 150 depending on a change of a temperature of the display 150. For example, when the display 150 is operated at 70 degrees Celsius, the electronic device 101 may generate a voltage imbalance (e.g., referring to the graph 600 of FIG. 6A and a graph 700 of FIG. 7A) which is larger than that a case in which the display 150 is operated at 40 degrees Celsius. Vcom 701 (e.g., 0.7 v), in which the display 150 of the electronic device 101 operates at 70 degrees Celsius, may be expressed larger than Vcom 601 (e.g., 0.5 v), in which the display 150 of the electronic device 101 operates at 40 degrees Celsius. When the electronic device 101 applies a first cancellation algorithm in the instance in which the temperature of the display 150 is 70 degrees Celsius, the electronic device 101 may apply a reverse bias of 0.5 v to the display 150. In this instance, the voltage imbalance occurring in the display 150 of the electronic device 101 may not be solved and a distortion of image information displayed in the display 150 may continuously occur. That is, when the reverse bias 0.5 v of the first cancellation algorithm is applied in a state in which a voltage difference occurring in the display 150 of the electronic device 101 is 0.7 v, a voltage difference of 0.2 v as shown in graph 710 of FIG. 7B remains. Therefore, the electronic device 101 may include two or more cancellation algorithms which are based on a temperature in the database and may apply a cancellation algorithm corresponding to the measured temperature. That is, a cancellation algorithm that corresponds to a reverse bias that is equal to about 0.7 v.

Figure 8A:
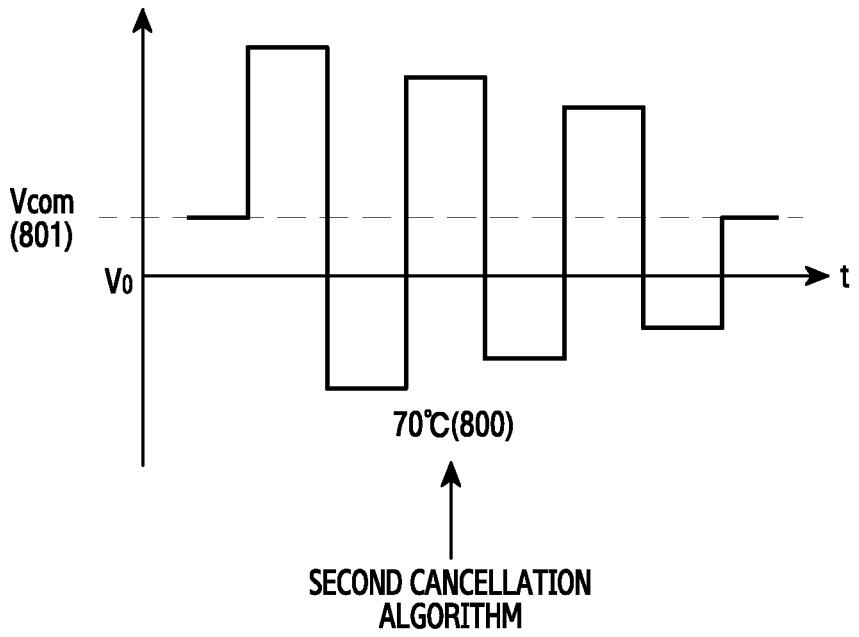
FIGS. 8A and 8B are diagrams illustrating a cancellation algorithm of a voltage imbalance in an operation of a display in an electronic device, according to an embodiment of the present disclosure.
Figure 8B:
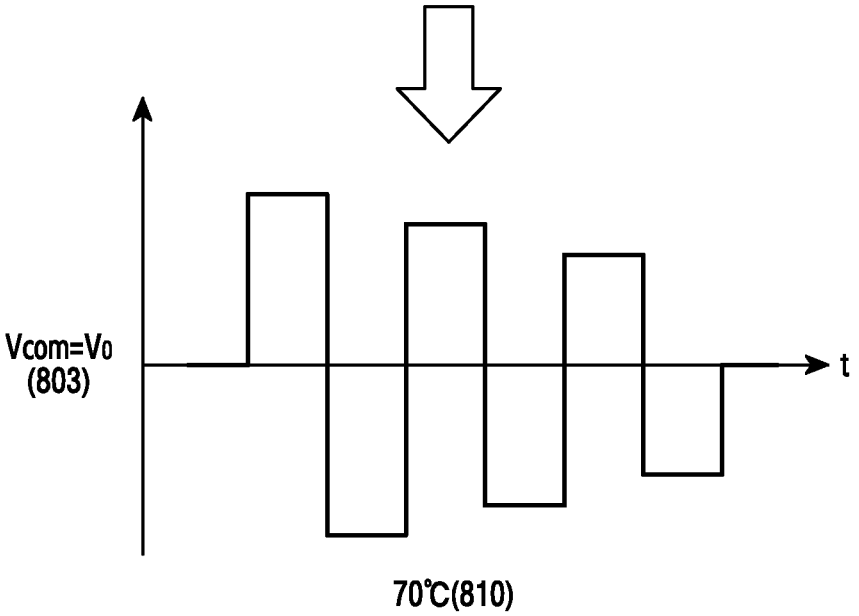

FIGS. 8A and 8B are diagrams illustrating a cancellation algorithm of a voltage imbalance in an operation of the display 150 in the electronic device 101, according to an embodiment of the present disclosure.

The electronic device 101 may apply at least one cancellation algorithm, while displaying image information, to the display 150. For example, the electronic device 101 may periodically or based on a user input measure a temperature of the display 150 at a predetermined time and determine a cancellation algorithm corresponding to the measured temperature. With respect to periodically measuring the temperature of the display 150, the electronic device 101 may measure the temperature of the display 150 in accordance with a predetermined time that is designated in the configuration information of the electronic device 101, while an image is being displayed on the display 150. The electronic device 101 may resolve a voltage imbalance occurring during an operation of displaying the image of the display 150 by applying the determined cancellation algorithm.

The electronic device 101 may include one or more cancellation algorithms. For example, the electronic device 101 can include a first cancellation algorithm and a second cancellation algorithm. The first cancellation algorithm and the second cancellation algorithm may correspond to a respective temperature of the display 150. For example, the first cancellation algorithm of the electronic device 101 may be configured to correct a voltage difference (e.g., 0.5 v) that corresponds to a temperature that ranges between 30 degrees Celsius to 50 degrees Celsius (or less than 30 degrees Celsius and greater than 50 degrees Celsius) and the second cancellation algorithm may be configured to correct a voltage difference (e.g., 0.7 v) that corresponds to a temperature that ranges between 60 degrees Celsius and 80 degrees Celsius (or less than 60 degrees Celsius and greater than 80 degrees Celsius). When it is identified that the measured temperature of the display 150 is 70 degrees Celsius, for example, the electronic device 101 may determine that the second cancellation algorithm corresponding to 70 degrees Celsius is suitable for resolving the voltage imbalance, as shown graph 800 of FIG. 8A. The electronic device 101 may apply the second cancellation algorithm to an image display operation of the display 150 to resolve this voltage imbalance, as shown in graph 810 of FIG. 8B.

If the electronic device 101 determines that the voltage imbalance occurring in the display 150 cannot be resolved by applying a first cancellation algorithm, the electronic device 101 may measure the temperature of the display 150 again and choose the second cancellation algorithm, or another cancellation algorithm, e.g., a third cancellation algorithm, a fourth cancellation algorithm, etc.

Figure 9:
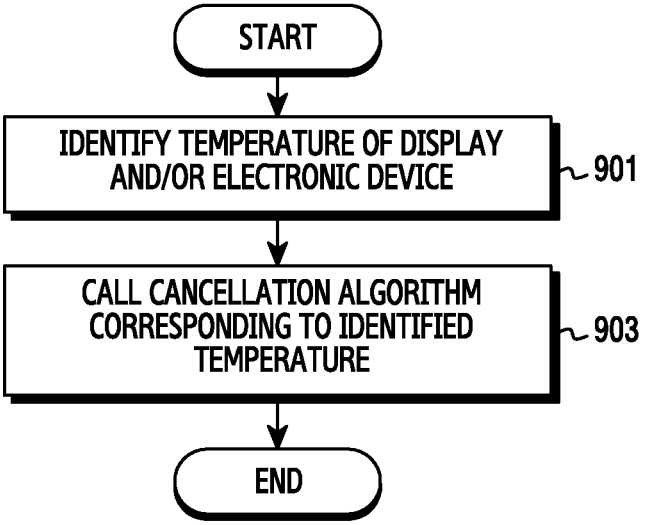
FIG. 9 is a flowchart of a method of applying a cancellation algorithm based on a display temperature in an electronic device, according to an embodiment of the present disclosure.

FIG. 9 is a flowchart of a method of applying a cancellation algorithm based on a display temperature in the electronic device 101, according to an embodiment of the present disclosure.

Referring to step 901, the electronic device 101 may measure the temperature of the display 150 or the temperature of the electronic device. For example, as described above, the electronic device 101 can measure, using the temperature sensor 170 (or a plurality of temperature sensors 170) included in the electronic device 101, the temperature of the electronic device 101 (such as an internal temperature of the electronic device 101), an external temperature of the electronic device 101, and a temperature of a battery included in the electronic device 101, and may use the measured temperature for resolving the voltage imbalance of the display 150. As noted above, the temperature sensor(s) 170 may be embodied in the form of a thermistor, a thermopile, an RTD, a semiconductor, a surface mount type sensor, a platinum wire, a conductive polymer, an optical fiber, a fluorescence sensor, an IR sensor, and a heat flux sensor.

The electronic device 101 may also measure the temperature of the display 150 based on a predetermined time period designated in configuration information of the electronic device 101. When measuring the temperature of the display 150 depending on a time period designated in configuration information, the electronic device 101 may measure the temperature in a time period designated from a time point in which an image is displayed on the display 150. Further, the electronic device 101 may measure the temperature of the display 150 based on a user input.

The electronic device 101 may measure the temperature of the display 150 when identifying (or detecting) a voltage imbalance occurring on the display 150. In identifying the voltage imbalance occurring in the display 150, the electronic device 101 may determine the temperature of the display 150 by measuring a voltage output while displaying a voltage and/or an image or image information provided to the display 150. In addition, the electronic device 101 may determine the temperature by identifying an image conversion time interval of the display 150. For example, in converting image information displayed in the display 150, the electronic device 101 may measure a time interval in which the image information is changed. The electronic device 101 may measure the time interval in which the image information displayed in the display 150 is changed by measuring a conversion speed corresponding to the image information provided to convert the image information displayed on the display 150. The electronic device 101 may determine whether an afterimage occurs (or whether the voltage imbalance occurs) in the display 150 based on the conversion speed of the measured voltage.

Referring to step 903, the electronic device 101 may request or determine a cancellation algorithm corresponding to the identified (measured) temperature of the display 150. The electronic device 101 may determine a specific temperature range corresponding to the measured temperature using the database including at least one specific temperature range, which corresponds to a cancellation algorithm, with respect to the temperature at which the display 150 of the electronic device 101 operates. The electronic device 101 may match or compare the specific temperature range with a cancellation algorithm included the database.

The electronic device 101 may associate a temperature of the display 150 with a first cancellation algorithm that corresponds to a first temperature that ranges up to 30 degrees Celsius, may associate the temperature of the display 150 with a second cancellation algorithm that corresponds to a second temperature that ranges from about 30 degrees Celsius to about 50 degrees Celsius, may associate a temperature of the display 150 with a third cancellation algorithm that corresponds to a third temperature that ranges from 50 degrees Celsius to about 60 degrees Celsius, and may associate a temperature of the display 150 with a fourth cancellation algorithm that corresponds to a fourth temperature that ranges from 60 degrees Celsius to about 80 degrees Celsius, or greater. As can be appreciated, more than four cancellation algorithms and corresponding temperature ranges can be used by the electronic device 101.

The electronic device 101 may determine a cancellation algorithm in a specific temperature range corresponding to the measured temperature of the display 150. The electronic device 101 may display an image on the display 150 by using the determined algorithm. For example, when it is determined that the measured temperature of the display 150 is in a range of the second cancellation algorithm (e.g., 47 degrees Celsius), the electronic device 101 may display the image on the display 150 by applying the second cancellation algorithm. The electronic device 101 can resolve the voltage imbalance of the display 150 by applying the second cancellation algorithm to a voltage imbalance occurring in the display 150 of 47 degrees Celsius.

Figure 10:
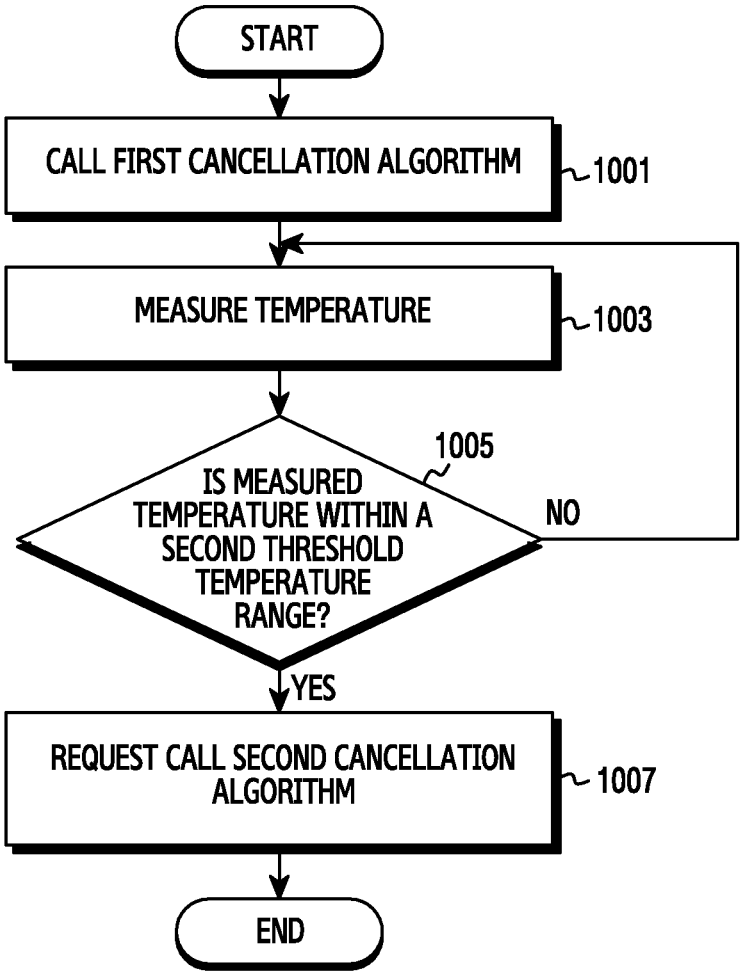
FIG. 10 is a flowchart of method of applying a cancellation algorithm based on a display temperature in an electronic device, according to an embodiment of the present disclosure.

FIG. 10 is a flowchart of method of applying a cancellation algorithm based on a display temperature in the electronic device 101, according to an embodiment of the present disclosure.

Referring to operation 1001, the electronic device 101 may apply a first cancellation algorithm in performing an image display operation of the display 150. The electronic device 101 may request or determine a first cancellation algorithm designated based on the configuration information at a predetermined time point while displaying an image on the display 150 and may apply the designated first cancellation algorithm to the image on the display 150.

Referring to step 1003, the electronic device 101 may measure the temperature of the display 150. The electronic device 101 may measure the temperature of the display 150 in a time interval designated from a start time point of displaying the image of the display 150. Further, the electronic device 101 may measure the temperature of the display 150 based on a user input.

Referring to step 1005, the electronic device 101 may determine whether the measured temperature of the display 150 is within a predetermined threshold temperature range (e.g., whether the measured temperature is greater than or equal to a first threshold temperature range). The predetermined threshold temperature ranges may be provided in the configuration information of the electronic device 101.

The electronic device 101 may determine between two or more cancellation algorithms based on the measured temperature. For example, the electronic device 101 may request or determine that the already determined cancellation algorithm, e.g., the first cancellation algorithm that was determined at step 1001, is sufficient for resolving voltage imbalances within the first threshold temperature range when the measured temperature of the display 150 is within the first threshold temperature range. When the measured temperature is not within the first threshold temperature range (i.e., the first cancellation algorithm is not sufficient for resolving voltage imbalances corresponding to the measured temperature), the electronic device 101 may determine that the second cancellation algorithm is required for resolving voltage imbalances corresponding to the measured temperature.

Referring to step 1007, the electronic device 101 can resolve a voltage imbalance occurring in displaying the image of the display 150 by applying a cancellation algorithm, e.g., the second cancellation algorithm, determined according to the measured temperature of the display 150. That is, when the measured temperature is within a second threshold temperature range, the electronic device 101 uses the second cancellation algorithm, to resolve voltage imbalances.

During step 1005, if the electronic device 101 determines that a measured temperature is not within a predetermined threshold temperature range, the electronic device 101 performs steps 1001-1005. For example, if during applying the second cancellation algorithm, it is determined that a measured temperature is not within the second threshold temperature range, e.g., the measured temperature is within the first threshold temperature range, the electronic device 101 can use the first cancellation algorithm. Similarly, if during applying the second cancellation algorithm, it is determined that a measured temperature is not within the second threshold temperature range, e.g., the measured temperature is within a third predetermined threshold temperature range, the electronic device 101 can use a third cancellation algorithm. A more detailed description of the above occurrences are described with respect to FIG. 11.

Figure 11:
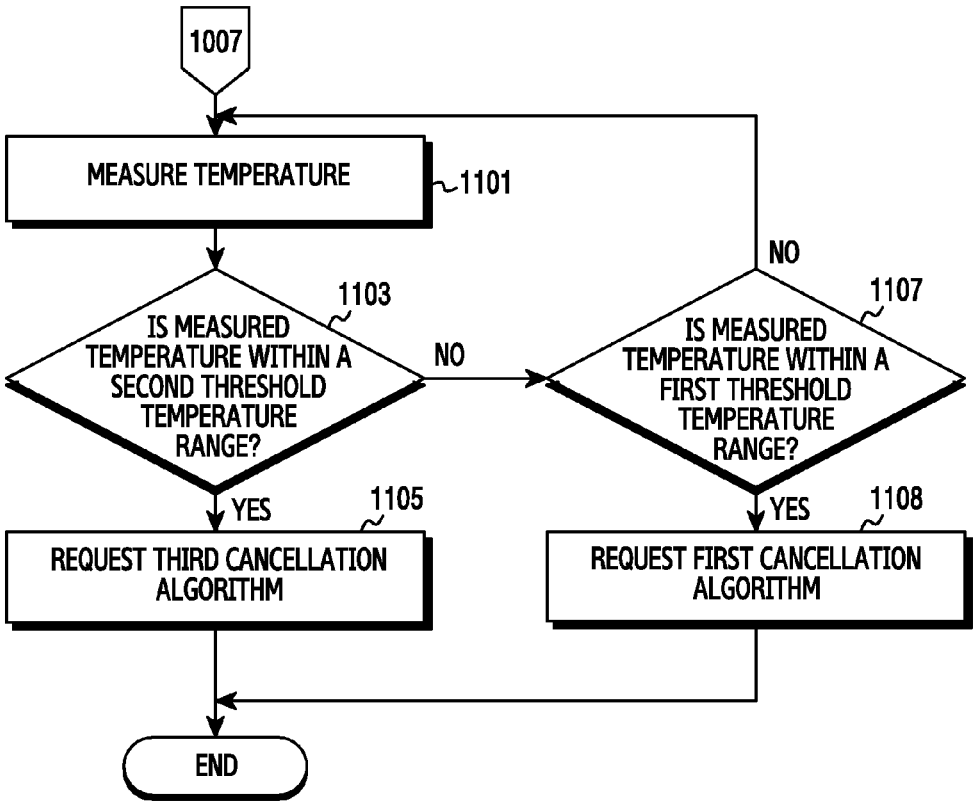
FIG. 11 is a flowchart of method of applying a cancellation algorithm based on a display temperature in an electronic device, according to an embodiment of the present disclosure.

FIG. 11 is a flowchart of method of applying a cancellation algorithm based on a display temperature in the electronic device 101, according to an embodiment of the present disclosure.

The electronic device 101 may be in a state in which a first cancellation algorithm is configured when a temperature of the display 150 does not satisfy the first threshold temperature, a state in which a second cancellation algorithm is configured when the temperature of the display 150 satisfies the first threshold temperature and does not satisfy a second threshold temperature, and a state in which a third cancellation algorithm is configured when the temperature of the display 150 satisfies with the second threshold temperature.

Referring to step 1101, which may correspond to an operation performed after operation 1007 of FIG. 10, the electronic device 101 may measure the temperature of the display 150. The electronic device 101 may measure the temperature of the display 150 in a time interval designated from a start time point of displaying the image of the display 150. Further, the electronic device 101 may measure the temperature of the display 150 based on a user input. Step 1101 may correspond to an operation of repeatedly performing operation 1003 of FIG. 10.

Referring to step 1103, the electronic device 101 may determine whether the measured temperature of the display 150 is within a predetermined temperature range (e.g., whether the measured temperature is greater than or equal to a second threshold temperature range). For example, the electronic device 101 may perform (e.g., request a third cancellation algorithm) step 1105 when the measured temperature of the display 150 is not within the second threshold temperature range, i.e., the measured temperature exceeds (e.g., is within a third threshold temperature range) the second threshold temperature range or falls below (e.g., is within a first threshold temperature range) the second threshold temperature range.

Referring to operation 1105, the electronic device 101 may resolve a voltage imbalance occurring in displaying the image of the display 150 by applying a cancellation algorithm, e.g., the third cancellation algorithm) determined according to the measured temperature of the display 150 The electronic device 101 may call the third cancellation algorithm when the measured temperature of the display 150 exceeds the second threshold temperature, and is within the third threshold temperature range. As the measured temperature of the display 150 exceeds the second threshold temperature range, the electronic device 101 may identify that the voltage imbalance greatly affects, in comparison to a case in which the temperature of the display 150 does not exceed the second threshold temperature, the image being displayed on the display 150. The electronic device 101 may display the image on the display 150 by requesting the third cancellation algorithm, and may resolve a distortion of image information displayed in the display 150 due to a voltage imbalance, which cannot be resolved by applying the second cancellation algorithm.

Referring to step 1107, the electronic device 101 may determine that the measured temperature of the display 150 is less than the second threshold temperature range and is in the first threshold temperature. For example, the electronic device 101 may perform (e.g., request the first cancellation algorithm) operation 1107 when the measured temperature of the display 150 is within the first threshold temperature range. If it is determined that the measured temperature is within the first threshold temperature range, the electronic device 101 may perform step 1101 to determine if the temperature of the display 150 is maintained within the first threshold temperature range.

Referring step 1108, the electronic device 101 may perform the image display operation of the display 150 by requesting the first cancellation algorithm.

Thus, by applying the first cancellation algorithm corresponding to the measured temperature of the display 150, voltage imbalances, which are caused by a reverse bias that is larger than a voltage difference for the voltage imbalance occurring due to the temperature of the display 150 when the second cancellation algorithm is being continuously applied to the existing image display operation of the display 150, can be eliminated.

According to the present disclosure, the display 150 of the electronic device 101 can be operated by applying one or more cancellation algorithms corresponding to a temperature of the display 150 so as to remove a distortion and/or an afterimage of a graphic interface displayed on the display 150.

The functions of the electronic device 101 that have been described herein with respect to FIGS. 9-11 may be performed under a control of the processor 120. The electronic device 101 may include a module for performing the functions described herein with respect FIGS. 9-11 that is separate from the processor 120.

The processor 120 may include a processor for making a control to measure a temperature of at least one part, e.g., the display 150, of the electronic device 101 through the temperature sensor 170, determine a cancellation algorithm corresponding to the measured temperature, and display an image in the display 150 on the basis of the cancellation algorithm. The processor 120 can correct a distortion of an image displayed in the display 150 based on the cancellation algorithm. The processor 120 can apply a reverse bias corresponding to the cancellation algorithm to the display 150. The processor 120 can select one of two or more cancellation algorithms corresponding to a specific temperature range in the electronic device 101 corresponding to the measured temperature. The processor 120 can measure a display 150 temperature of the electronic device 101 and measure a temperature of at least one second part, e.g., an internal part, of the electronic device 101. The processor 120 can measure a second temperature of the at least one second part of the electronic device, determine a second algorithm corresponding to the measured second temperature, and display an image based on the second cancellation algorithm. The processor 120 may release an application of an already applied cancellation algorithm and apply the determined algorithm. The processor 120 can measure a temperature of the at least one part of the electronic device when a voltage imbalance of the display is not resolved. The processor 120 can measure the temperature of the at least one part of the electronic device when a distortion occurs on the image due to at least one of a voltage imbalance occurring in the display and a voltage conversion speed of the display.

Each of the above described elements of the electronic device 101 may be formed of one or more components, and the name of a corresponding element may vary according to the type of the electronic device 101. The electronic device 101, may include at least one of the above described elements and may exclude some of the elements or further include other additional elements. Further, some of the elements of the electronic device 101 may be coupled to form a single entity while performing the same functions as those of the corresponding elements before the coupling.

At least some of the devices (e.g., modules or functions thereof) or methods (e.g., operations) according to various embodiments of the present disclosure may be implemented by, for example, by a command stored in a non-transitory computer-readable storage medium in the form of a programming module. When the command is executed by one or more processors (e.g., the processor 120), the one or more processors may execute a function corresponding to the command. The non-transitory computer-readable storage medium may be, for example, the memory 130. At least some of the programming modules may be implemented (e.g., executed) by, for example, the processor 120. At least a part of the programming module may, for example, include a module, a program, a routine, a set of instructions, or a process for performing at least one function.

The electronic device 101 may include a non-transitory computer readable storage medium, in which a program is stored, the program including an operation of measuring a temperature of at least a part of the electronic device 101, an operation of determining a cancellation algorithm corresponding to the measured temperature, and an operation of displaying an image on the basis of the cancellation algorithm.

The computer readable recording medium may include magnetic media such as a hard disc, a floppy disc, and a magnetic tape, optical media such as a Compact Disc Read Only Memory (CD-ROM) and a Digital Versatile Disc (DVD), magneto-optical media such as a floptical disk, and hardware devices specifically configured to store and execute program commands, such as a Read Only Memory (ROM), a Random Access Memory (RAM), and a flash memory. In addition, the program instructions may include high class language codes, which can be executed in a computer by using an interpreter, as well as machine codes made by a compiler. Any of the hardware devices as described above may be configured to work as one or more software modules in order to perform the operations according to various embodiments of the present disclosure, and vice versa.

The above-described components of the electronic device 101 may each be configured with one or more components, and names of the components may vary according to the type of the electronic device 101. The electronic device 101 may include at least one of the above-described components, some of which can be omitted, or may further include other additional components. In addition, some of the components of the electronic device 101 are configured as one entity by being combined with one another, so the functions of the components, which are defined before the combination, may be performed in the same manner.

Any of the modules or programming modules described herein may include at least one of the above described elements, exclude some of the elements, or further include other additional elements. The operations performed by the modules, programming module, or other elements may be executed in a sequential, parallel, repetitive, or heuristic manner. Further, some operations may be executed in a different order, some of the operations may be omitted, or other operations may be added.

A storage medium storing commands is provided. The commands are configured to allow one or more processors to execute one or more operations when the commands are executed by the one or more processors. The one or more operations may include: configuring one or more categories in a hierarchical structure; mapping one or more contents and the one or more categories based on at least one piece of information on the one or more contents and information on the categories; and when content-related information of each category determined according to the mapping meets a preset condition, updating the hierarchical structure of the categories based on the preset condition.

While the present disclosure has been shown and described with reference to certain embodiments thereof, it should be understood by those skilled in the art that many variations and modifications of the method and apparatus described herein will still fall within the spirit and scope of the present disclosure as defined in the appended claims and their equivalents.

What is claimed is:

1. A method for reducing an afterimage caused by ions accumulated in alignment layers of a liquid crystal display (LCD) in an electronic device, the method comprising:

measuring a temperature of at least one part of the electronic device;

determining a reverse bias voltage based at least in part on the measured temperature;

applying the reverse bias voltage to a pair of electrodes to which the alignment layers are respectively attached, wherein the pair of electrodes are included in the LCD; and displaying, based on the determined reverse bias voltage, an image from which the afterimage is reduced.

2. The method of claim 1, further comprising:

determining, among a plurality of temperature ranges, a temperature range including the measured temperature, wherein information regarding the plurality of temperature ranges has been stored in the electronic device; and determining the reverse bias voltage mapped to the determined temperature range.

3. The method of claim 1, wherein the electrodes comprise an upper electrode and a lower electrode, and wherein the afterimage is caused by an imbalance of voltage between the upper electrode and the lower electrode.

4. The method of claim 1, further comprising:

determining a conversion speed of a voltage outputted to the LCD; and determining the reverse bias voltage based at least in part on the conversion speed and the measured temperature.

5. The method of claim 1, wherein measuring the temperature of the at least one part of the electronic device comprises measuring a temperature of the LCD in the electronic device or a temperature of a battery of the electronic device.

6. The method of claim 1, wherein applying the reverse bias voltage comprises applying the reverse bias voltage by shifting a reference point of an alternating current (AC) voltage provided to the electrodes in the LCD.

7. The method of claim 1, wherein applying the reverse bias voltage comprises applying the reverse bias voltage to the LCD to disperse the accumulated ions.

8. The method of claim 1, further comprising:

measuring a second temperature of the at least one part of the electronic device when a voltage imbalance of the LCD caused by the accumulated ions is not resolved.

9. The method of claim 1, wherein measuring the temperature of the at least one part of the electronic device comprises:

periodically measuring the temperature; or measuring the temperature in response to receiving a user input.

10. An electronic device for reducing an afterimage caused by ions accumulated in alignment layers of a liquid crystal display (LCD) comprising:

a memory storing instructions;

a temperature sensor;

the LCD including the alignment layers and a pair of electrodes; and a processor, electrically connected to the temperature sensor and the LCD, configured to execute the stored instructions to:

measure a temperature of at least one part of the electronic device through the temperature sensor, determine a reverse bias voltage based at least in part on the measured temperature, apply the reverse bias voltage to the pair of electrodes to which the alignment layers are respectively attached, and display, based on the determined reverse bias voltage, an image from which the afterimage is reduced.

11. The electronic device of claim 10, wherein the processor is configured to execute the stored instructions to:

determine, among a plurality of temperature ranges, a temperature range including the measured temperature, wherein information regarding the plurality of temperature ranges has been stored in the electronic device, and determine the reverse bias voltage mapped to the determined temperature range.

12. The electronic device of claim 10, wherein the electrodes comprise an upper electrode and a lower electrode, and wherein the afterimage is caused by an imbalance of a voltage between the upper electrode and the lower electrode.

13. The electronic device of claim 10, wherein the processor is configured to execute the stored instructions to:

determine a conversion speed of a voltage outputted to the LCD; and determine the reverse bias voltage based at least in part on the conversion speed and the measured temperature.

14. The electronic device of claim 10, wherein the processor is configured to execute the stored instructions to measure a temperature of the LCD in the electronic device or a temperature of a battery of the electronic device.

15. The electronic device of claim 10, wherein the processor is configured to execute the stored instructions to apply the reverse bias voltage by shifting a reference point of an alternating current (AC) voltage provided to the electrodes in the LCD.

16. The electronic device of claim 10, wherein the processor is configured to execute the stored instructions to apply the reverse bias voltage to the LCD to disperse the accumulated ions.

17. The electronic device of claim 10, wherein the processor is further configured to execute the stored instructions to measure a second temperature of the at least one part of the electronic device when a voltage imbalance of the LCD caused by the accumulated ions is not resolved.

18. The electronic device of claim 10, wherein the processor is configured to execute the stored instructions to:

periodically measure the temperature; or measure the temperature in response to receiving a user input.

19. A non-transitory computer readable storage medium including instructions that when executed perform a method for reducing an afterimage caused by ions accumulated in alignment layers of a liquid crystal display (LCD) in an electronic device, the method comprising:

measuring a temperature of at least one part of the electronic device;

determining a reverse bias voltage based at least in part on the measured temperature;

applying the reverse bias voltage to a pair of electrodes to which the alignment layers are respectively attached, wherein the pair of electrodes are included in the LCD; and displaying, based on the determined reverse bias voltage, an image from which the afterimage is reduced.

* * * * *